US005300863A

United States Patent [19]

Mayer

[11] Patent Number: 5,300,863

[45] Date of Patent: Apr. 5, 1994

[54] AUXILIARY LIGHTING CIRCUIT FOR A GASEOUS DISCHARGE LAMP

[75] Inventor: Thomas J. Mayer, Hoffman Estates, Ill.

[73] Assignee: Appleton Electric Company, Chicago, Ill.

[21] Appl. No.: 930,743

[22] Filed: Aug. 14, 1992

[51] Int. Cl.[5] ..... H05B 41/16

[52] U.S. Cl. ..... 315/276; 315/161; 315/88; 315/90; 315/313; 315/320; 315/324; 315/136

[58] Field of Search ..... 315/161, 88, 90, 194, 315/313, 320, 324, 362, 136, 276

[56] References Cited

U.S. PATENT DOCUMENTS

| | | | |
|---|---|---|---|
| Re. 32,904 | 4/1989 | Pacholok | 363/131 |
| 3,517,254 | 6/1970 | McNamara | 315/91 |
| 3,611,432 | 10/1971 | Babcock | 315/92 |
| 3,742,295 | 6/1973 | Irie | 315/194 |
| 3,805,059 | 4/1974 | Long et al. | 250/206 |
| 3,890,534 | 6/1975 | Horowitz | 315/92 |
| 3,925,705 | 12/1975 | Elms et al. | 315/246 |
| 3,927,348 | 12/1975 | Zawadski | 315/92 X |
| 3,976,910 | 8/1976 | Owens et al. | 315/92 |
| 4,005,331 | 1/1977 | Horowitz | 315/136 X |
| 4,250,531 | 2/1981 | Ahrens | 361/2 |
| 4,488,092 | 12/1984 | Chikuma | 315/320 X |
| 4,503,477 | 3/1985 | Henriksen et al. | 361/2 |
| 4,568,857 | 1/1986 | Head | 315/194 X |
| 4,613,934 | 9/1986 | Pacholok | 363/131 |
| 5,023,519 | 6/1991 | Jensen | 315/242 |

*Primary Examiner*—Robert J. Pascal
*Assistant Examiner*—Reginald A. Ratliff
*Attorney, Agent, or Firm*—Jones, Day, Reavis & Pogue

[57] ABSTRACT

A non-arcing electrical switch is disclosed wherein a solid-state switching element is operated in response to current flow within an external circuit. The switch is particularly suitable for use within an auxiliary lighting circuit of a gaseous discharge lamp. Because the switch operates in response to the current drawn by the gaseous discharge lamp rather than a specific sensed voltage, it may be used with virtually any type of clamp or lamp operating circuit.

11 Claims, 1 Drawing Sheet

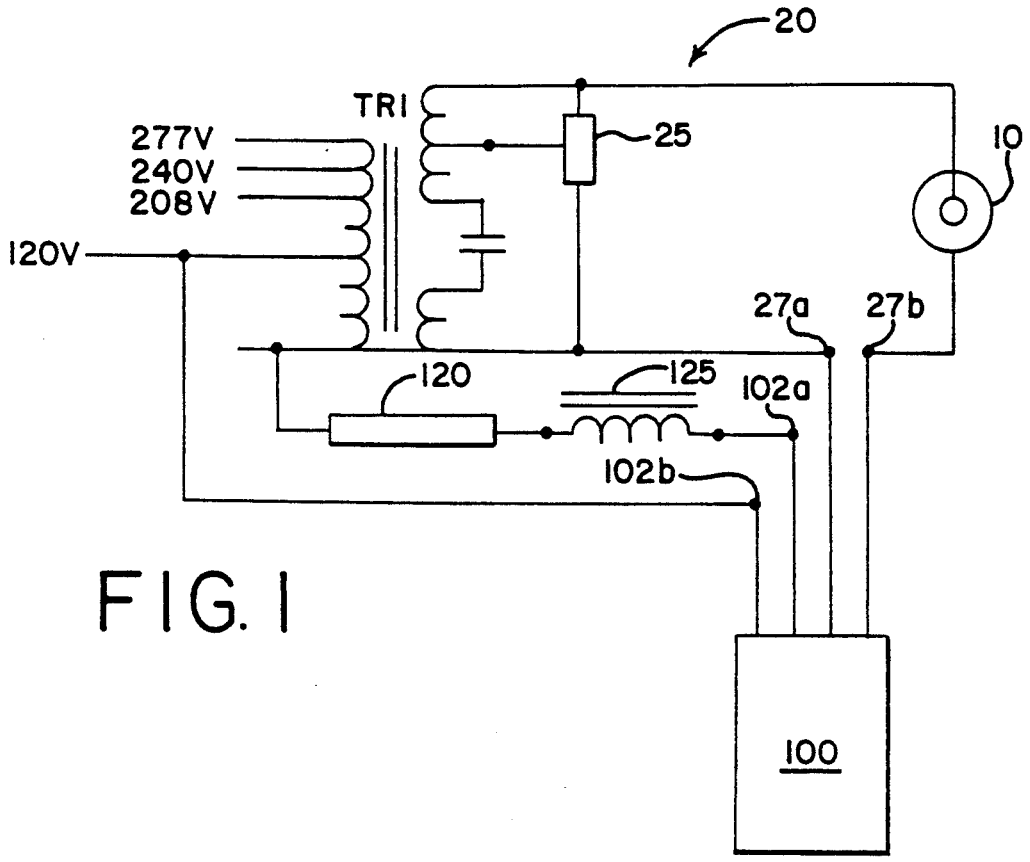
FIG. 1
FIG. 2
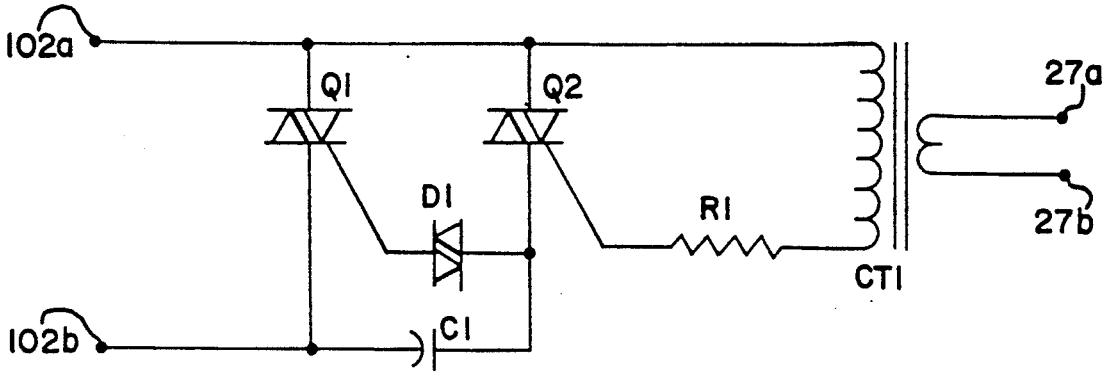

AUXILIARY LIGHTING CIRCUIT FOR A GASEOUS DISCHARGE LAMP

BACKGROUND

It has long been considered desirable for the starting and operating circuits of gaseous discharge lamps to incorporate circuitry for automatically lighting an auxiliary lamp when the gaseous discharge lamp is extinguished. Examples of such circuits are found in U.S. Pat. Nos. 3,976,910, 3,611,432 and 3,517,254, the disclosures of which are hereby incorporated by reference.

Previous auxiliary lighting circuits, however, are severely limited in their range of application. This is because those circuits are designed to measure specific voltage levels in order to determine whether the gaseous discharge lamp is operating or not. From that determination, the auxiliary lighting source is either energized or maintained in an off state. Voltage levels of gaseous discharge lamp operating circuits vary greatly, however, depending upon the type of lamp (e.g., metal halide or high pressure sodium), the voltage of the power source, and the specific design of the operating circuit. Indeed, most of the previous auxiliary lighting circuits are designed as an inherent part of the main lamp operating circuit and, therefore, have no general applicability to other lamps.

SUMMARY OF THE INVENTION

It is an object of the present invention to provide a non-arcing electrical switch which operates in response to current flow.

It is a further object of the present invention to provide an auxiliary lighting circuit for a gaseous discharge lamp which may be used with virtually any type of lamp or lamp operating circuit.

It is a further object for the auxiliary lighting circuit to employ a non-arcing switch suitable for use in a potentially explosive environment.

The present invention is a non-arcing electrical switch which operates in response to the current flowing in an external circuit. In a preferred embodiment, the switch comprises a current transformer having primary and secondary coils, and a solid-state switching element (such as a triac) connected to the secondary coil of the current transformer so as to operate responsive to the current flowing through the primary coil. Such an electrical switch may be employed in a wide variety of applications but is particularly suitable for use in an auxiliary lighting circuit for gaseous discharge lamps. In accordance with the present invention, the primary coil of the current transformer is designed to be connected in series with a gaseous discharge lamp in the lamp's operating circuit. A voltage is thus induced in the current transformer's secondary coil which is proportional to the current drawn by the gaseous discharge lamp. A solid-state switching element such as a triac is connected in series between an auxiliary lighting source and an auxiliary power source so that the auxiliary lighting source is either energized or not depending upon whether the triac is conductive or not, respectively. The gate input of the triac is operably connected to the secondary coil so as to be rendered non-conductive when current is drawn by the gaseous discharge lamp and conductive otherwise. By detecting current in the lamp's operating circuit rather than voltage, the auxiliary lighting circuit is not limited to any one type of lamp operating circuit.

Other objects, features, and advantages of the invention will become evident in light of the following detailed description considered in conjunction with the with the referenced drawings of a preferred exemplary embodiment according to the present invention.

BRIEF DESCRIPTION OF THE DRAWINGS

FIG. 1 is a schematic of an operating circuit for a gaseous discharge lamp.

FIG. 2 is a schematic of an auxiliary lighting circuit in accordance with the present invention.

DETAILED DESCRIPTION OF THE INVENTION

FIG. 1 shows a conventional gaseous discharge lamp 10 connected to a conventional starting and operating circuit 20. The circuit 20 in this particular embodiment comprises a multitap transformer ballast TR1 which provides a plurality of input taps on the primary winding so that different AC voltages from a power source (e.g., 277 V, 240 V, 208 V, or 120 V) can be used to operate the lamp 10. On the secondary side of transformer TR1 and connected in parallel with lamp 10 is a starter 25 which may be of a standard type such as disclosed in U.S. Pat. No. 3,976,910.

An auxiliary lighting circuit 50 in accordance with the present invention comprises a switch 100 having two terminals **27*a* and 27*b* connected in series with the gaseous discharge lamp 10. The switch 100 also has two terminals 102*a* and 102*b* are connected in series with an auxiliary gaseous discharge lamp 120 and its associated ballast 125** to an auxiliary power source which, in the embodiment shown, is 120 V.

Switch 100 detects the current drawn by the lamp 10 and which flows between terminals **27*a* and 27*b*. When the lamp 10 is operating and hence drawing current, switch 100 acts so as to open circuit the terminals 102*a* and 102*b*, thus preventing the auxiliary lamp 120 from operating. When the lamp 10 ceases to operate, as indicated by the absence of current between terminals 27*a* and 27*b*, switch 100 provides a conductive path between terminals 102*a* and 102*b*, thus energizing the auxiliary lamp 120. Although the operation of the auxiliary lighting circuit 50** has been described with reference to a specific lamp circuit, it should be appreciated that one of the primary advantages of the present invention is that it can be used in virtually any lamp circuit.

FIG. 2 illustrates a presently preferred embodiment of the switch 100. Terminals **27*a* and 27*b* are connected across the primary winding of a current transformer CT1 which is preferably a high ratio current transformer. An alternating current through the primary coil of transformer CT1** generates a voltage across its secondary coil proportional to the current through the primary coil.

Triac Q1 is connected across terminals **102*a* and 102*b*. One terminal of triac Q2 is connected to terminal 102*a* and the other connected to terminal 102*b* through a phase shifting capacitor C1. One side of the CT1 secondary coil is connected to terminal 102*a* while the other side is connected to the gate input of triac Q2 through a current limiting resistor R1. The junction between triac Q2 and capacitor C1 is connected to the gate input of triac Q1 through a diac D1**.

A voltage across the CT1 secondary coil due to a current through the CT1 primary is thus applied to the gate of triac Q2 to render it conducting. With Q2 conducting, triac Q1 is maintained in the off state since insufficient voltage is applied through diac D1 to the gate input of Q1. Terminals 102*a* and 102*b* are thus effectively open circuited. On the other hand, when current through the CT1 primary ceases, no voltage appears across the CT1 secondary, which turns triac Q2 off. Terminal 102*b* connected to the auxiliary power source is able to apply a sufficient voltage through capacitor C1 and diac D1 to the gate input of Q1 to turn Q1 on and enable current to flow from terminal 102*a* to 102*b*. The auxiliary lamp 120 is thus turned on or off in accordance with the operation of lamp 10.

In one particular embodiment of the switch 100, the particular components are as follows:

1. Current transformer CT1 - Model PB SA-2 manufactured by Forest Electric Company of Melrose Park, Ill. or Model PN T27Pe manufactured by VXF Transformer Corp. of Bartlett, Ill.

2. Resistor RI - ¼ watt 5% carbon film or composition with a voltage drop across the device of 6 VAC or less.

3. Triac Q1 - 400 volt, 4 amp non-isolated power triac (e.g., Teccor PN Q4004F31).

4. Triac Q3 - 400 volt, 4 amp isolated logic triac (e.g., Teccor PNL401E3).

5. Diac DI - 40 volt, 2 amp diac (e.g. Teccor PN HT-40).

6. Capacitor C1 - 0.1 Mfd, 400 volt metalized polyester capacitor (e.g., Panasonic PN ECQ-E4104KZ).

Although the invention has been described in conjunction with the foregoing specific embodiment, many alternatives, variations, and modifications will be apparent to those of ordinary skill in the art. Those alternatives, variations, and modifications are intended to fall within the scope of the following appended claims.

I claim:

1. A non-arcing electrical switch, comprising:

a current transformer having primary and secondary coils such that a current flowing through the primary coil causes a voltage at the secondary coil;

a first solid-state switch having an input and an output and being coupled to the secondary coil such that a voltage at the secondary coil causes the first switch to electrically close between its input and output, and such that no voltage at the secondary coil causes the first switch to electrically open between its input and output; and a second solid-state switch coupled to the first solid-state switch, and having an input and output, such that when the first solid-state switch is closed between its input and output, the second solid-state switch is substantially always open between its input and output, and when the first solid-state switch is open between its input and output, the second solid-state switch is substantially always closed between its input and output.

2. A non-arcing switch as in claim 1 wherein the first solid-state switch is a first triac having a gate element.

3. The switch as set forth in claim 2 wherein the second solid-state switch is a second triac having a gate element and being coupled to the first triac with the gate element of the second triac being connected through a diac to the first triac output.

4. The switch as set forth in claim 3 wherein the secondary coil of the current transformer is connected to the gate element of the first triac.

5. The switch as set forth in claim 4 wherein the secondary coil of the current transformer is connected to the gate element of the first triac through a current limiting resistor.

6. The switch as set forth in claim 5 further comprising a phase shifting capacitor coupled between the output of the first triac and the output of the second triac.

7. An auxiliary lighting circuit for a gaseous discharge lamp comprising:

a current transformer comprising primary and secondary coils with the primary coil connected in series between the gaseous discharge lamp and a power source so as to produce a voltage in the secondary coil in proportion to the current drawn by the gaseous discharge lamp;

a first gated triac connected in series between an auxiliary light source and an auxiliary power source; and a second gated triac coupled between the first gated triac and the current transformer such that the first gated triac is rendered to a non-conductive state only when current is drawn by the gaseous discharge lamp, and rendered to a conductive state only when no current is drawn by the gaseous discharge lamp so as to supply power to the auxiliary lighting source only when no current is drawn by the gaseous discharge lamp.

8. The auxiliary lighting circuit as set forth in claim 7 wherein the second gated triac is coupled to the first gated triac, the gating of the first triac being received through a diac coupled to the second gated triac.

9. The auxiliary lighting circuit as set forth in claim 8 wherein the secondary coil of the current transformer is connected as a gating input and the second gated triac.

10. The auxiliary lighting circuit as set forth in claim 9 wherein the secondary coil of the current transformer is connected as a gating input of the second gated triac through a current limiting resistor.

11. The auxiliary lighting circuit as set forth in claim 10 further comprising a phase-shifting capacitor coupled between the output of the first triac and the output of the second triac to maintain the first triac in the conductive state until the second triac conducts.

* * * * *

UNITED STATES PATENT OFFICE

CERTIFICATE OF CORRECTION

Patent No. 5,300,863 Dated April 5, 1994

Inventor(s) Thomas J. Mayer

It is certified that error appears in the above-identified patent and that said Letters Patent is hereby corrected as shown below:

Column 2, line 5, after conjunction, delete "with the".

Column 4, line 46, change "and" to --to--.

Signed and Sealed this

Ninth Day of May, 1995

Bruce Lehman

*Attest:*

BRUCE LEHMAN

*Attesting Officer*

*Commissioner of Patents and Trademarks*